United States Patent [19]

Adachi et al.

[11] Patent Number: 4,837,482

[45] Date of Patent: Jun. 6, 1989

[54] COLOR PICTURE TUBE HAVING REDUCED LOCAL DOMING

[75] Inventors: Osamu Adachi, Osaka; Osamu Konosu, Kyoto, both of Japan

[73] Assignee: Matsushita Electronics Corporation, Japan

[21] Appl. No.: 172,391

[22] Filed: Mar. 24, 1988

[30] Foreign Application Priority Data

Mar. 26, 1987 [JP] Japan ..... 62-72449

[51] Int. Cl.[4] ..... H01J 29/07

[52] U.S. Cl. ..... 313/402; 313/408

[58] Field of Search ..... 313/402, 408

[56] References Cited

U.S. PATENT DOCUMENTS 4,677,339 6/1987 Inoue et al. ..... 313/402

*Primary Examiner*—Kenneth Wieder

*Attorney, Agent, or Firm*—Lowe, Price, LeBlanc, Becker & Shur

[57] ABSTRACT

A color picture tube includes a rectangular shadow mask having a longer axis and a shorter axis. The shadow mask has a curved surface. A point of the curved surface of the shadow mask is represented by an orthogonal coordinate system having an X component, a Y component, and a Z component. The coordinate system has an origin coincident with a center of the curved surface. The X component is measured along the longer axis. The Y component is measured along the shorter axis. The Z component is measured in a direction perpendicular to directions of the longer and shorter axes. A sagittal height of the curved surface represented by the Z component and measured from the origin is given by a polynomial including a term of a sixth-degree power of one of the X component and the Y component.

2 Claims, 5 Drawing Sheets

COLOR PICTURE TUBE HAVING REDUCED LOCAL DOMING

BACKGROUND OF THE INVENTION

This invention relates to a color picture tube and specifically relates to a flatter-face color picture tube.

In general picture tubes, shadow masks are made of low-carbon mild steel and are heated by impacts of electron beams so that they tend to deform toward phosphor screens. Such a deformation is referred to as doming. Especially, local doming generally has a considerable degree for the following reason. In a television receiver, a beam current has a limited average so that when a displayed picture has a portion brighter than other portions, the density of beam current corresponding to the bright portion is higher than that corresponding to the other portions.

SUMMARY OF THE INVENTION

It is an object of this invention to provide a color picture tube which reduces or prevents local doming.

A color picture tube of this invention includes a rectangular shadow mask having a longer axis and a shorter axis. The shadow mask has a curved surface. A point of the curved surface of the shadow mask is represented by an orthogonal coordinate system having an X component, a Y component, and a Z component. The coordinate system has an origin coincident with a center of the curved surface. The X component is measured along the longer axis. The Y component is measured along the shorter axis. The Z component is measured in a direction perpendicular to directions of the longer and shorter axes. A sagittal height of the curved surface represented by the Z component and measured from the origin is given by a polynomial including a term of sixth-degree power of one of the X component and the Y component.

DESCRIPTION OF THE PREFERRED EMBODIMENT

Prior to the detailed description of this invention, convention picture tubes will be described hereinafter.

Figure 1:
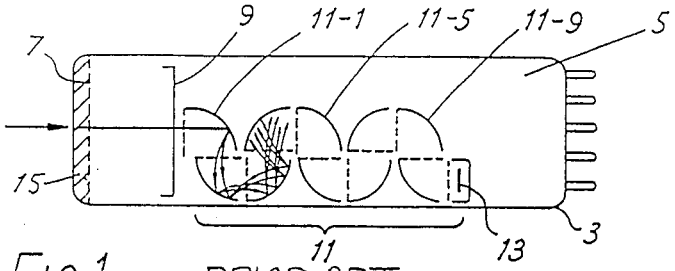
FIG. 1 PRIOR ART
FIG. 1 is a sectional view of part of a prior art picture tube.

As shown in FIG. 1, a typical picture tube includes a shadow mask 1 and a face panel 3. The shadow mask 1 extends in rear of the face panel 3 and parallel to the face panel 3. The shadow mask 1 is supported on a mask frame 4.

It is now assumed that the shadow mask 1 locally projects toward the face panel 3 due to thermal deformation and thus forms local domings 101 and 102 having equal degrees.

As a result of the formation of the local doming 101, an aperture through the portion of the shadow mask 1 exposed to the local doming 101 shifts from a position M1 to a position M1'. In accordance with the shift of this aperture, the path of an electron beam having a deflection angle A1 and passing through the aperture moves from a line 200 to a line 201 and thus the position (electron beam impinging pont) at which the electron beam encounters the inner surface of the face panel 3 moves from a point P1 to a point P1'. Accordingly, the electron beam shifts by a quantity $\Delta \times 1$ corresponding to the distance between the points P1 and P1'.

As a result of the formation of the local doming 102, an aperture through the portion of the shadow mask 1 exposed to the local doming 102 shifts from a position M2 to a position M2'. In accordance with the shift of this aperture, the path of an electron beam having a deflection angle A2 and passing through the aperture moves from a line 202 to a line 203 and thus the position (electron beam impinging point) at which the electron beam encounters the inner surface of the face panel 3 moves from a point P2 to a point P2'. Accordingly, the electron beam shifts by a quantity $\Delta \times 2$ corresponding to the distance between the points P2 and P2'.

As understood from FIG. 1, in the case where the local domings 101 and 102 have equal degrees, the beam shift quantities depend on the deflection angles of the beams and the beam shift quantity $\Delta \times 2$ is greater that the beam shift quantity $\Delta \times 1$. Specifically, the beam shift quantity is approximately proportional to tan A, where the letter A denotes the beam deflection angle. In regions of a screen of the picture tube near edges thereof, the beam deflection angles are relatively great so that the beam shift quantities tend to be large.

Some color picture tubes have face panels of smaller curvatures which are generally called "flat face panels". In these flatter face picture tubes, shadow masks are of smaller curvatures in conformity with the face panels. The degree of a local doming is essentially proportional to the radius of curvature of the shadow mask so that the flatter face picture tubes tend to be subjected to greater local domings.

High-resolution color picture tubes have fine-pitch phosphor screens in which phosphor dots or stripes are arranged at smaller pitches than those in normal picture tubes. In such a high-resolution picture tube, an electron beam landing clearance is small.

In a high-resolution color picture tube having a flatter face panel, local domings tend to cause serious problems such as decreases in colorimetric purity.

Figure 2:
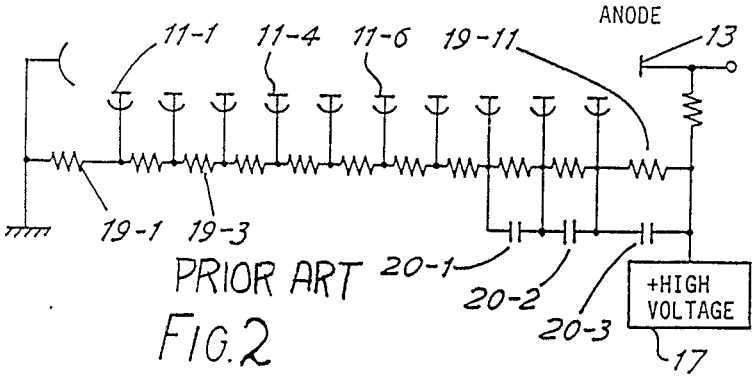
PRIOR ART FIG. 2
FIG. 2 is a sectional view of part of a prior art picture tube.

In general, as shown in FIG. 2, phosphor dots or stripes and electron beam impinging points R1, G1, B1, R2, G2, B2, . . . are arranged at regular pitches Ph1, Ph2, . . . . The letter p denotes the distance between a shadow mask 1 and the deflection center of electron beams 2 emitted from respective electron guns B, G, and R. The characters S1 and S2 denote intervals between the electron beams at the deflection center. The letter q denotes the distance between the shadow mask 1 and a phosphor screen on a face panel 3. The character aH denotes the pitch between adjacent apertures M1 and M2 through the shadow mask 1. The pitches between the impinging points R1, G1, and B1 of the three electron beams moving to the phosphor screen via the aperture M1 are equal to the pitches between the impinging points R2, G2, and B2 of the three electron beams moving to the phosphor screen via the aperture M2 when the following conditions are satisfied.

$$q=(aH\cdot L)/(3S) \quad (1)$$

$$L=p+q,\ S=(S1+S2)/2$$

The internal structure of a picture tube is actually designed so that the conditions (1) are satisfied.

Figure 3:
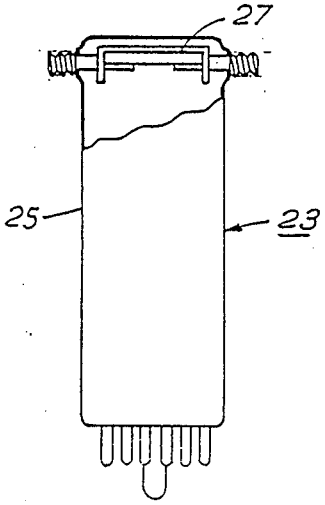
FIG. 3 is a plan view of part of the prior art picture tube.

As shown in FIG. 3, the matching between the electron beam impinging points and the phosphor elements are measured at a large number of points on the phosphor screen. The shadow mask is generally designed on the basis of data available during the measurement of the matching.

In one example, the curved surface of a shadow mask is represented by circular arcs different in dependence on direction angles as described in the following. The curved surface of a shadow mask will now be expressed in a three-dimensional orthogonal coordinate system having an origin O coincident with the center of the shadow mask. The character $\theta$ denotes a direction angle which is positive in the counterclockwise direction. The X axis corresponds to the direction angle $\theta=0°$. The character Z denotes a sagittal height from the origin O at a distance r starting from the origin O. The shadow mask curved surface is designed so as to satisfy the following equations using coefficients R0–Rn.

$$Z = R - (R^2 - r^2)^{\frac{1}{2}} \quad (2)$$

$$R = \sum_{i=0}^{n} Ri \cdot \cos(2 \cdot i \cdot \theta) \quad (3)$$

$$X = r \cdot \cos\theta,\ Y = r \cdot \sin\theta \quad (4)$$

In the shadow mask curved surface given by the equations (2)–(4), the matching between the electron beam impinging points and the phosphor elements can be acceptable at points F1–F5 (see FIG. 3) near edges of the screen but the matching is generally unacceptable at points F6–F8 (see FIG. 3) in intermediate portions of the screen. If the radius of curvature of the shadow mask is decreased, the sagittal height increases and thus the distance q (see FIG. 2) between the shadow mask and the phosphor screen increases. As the distance q increases, the pitch aH (see FIG. 2) increases and thus a general pitch TPH (see FIG. 2) increases. The increase in the pitch TPH lowers the resolution.

The curved surface of a shadow mask which allows acceptable matching at all the points of FIG. 3 is expressed in the following equation.

$$Z=\alpha1\cdot X^2+\alpha2\cdot X^4+\alpha3\cdot Y^2+\alpha4\cdot X^2\cdot Y^2+\alpha5\cdot X^4\cdot Y^2 +\alpha6\cdot Y^4+\alpha7\cdot Y^4+\alpha8\cdot X^4\cdot Y^4 \quad (5)$$

The radius of curvature of the surface of the equation (5) is considered as follows.

In general, a smoothly curved surface has a maximal curvature K1 and a minimal curvature K2 in different directions respectively at a point. The value of curvature in an arbitrary direction resides between the maximal and minimal curvatures K1 and K2. Accordingly, in the case where the radius of curvature at a point on a curved surface is handled quantitatively, an average curvature "$K=(K1+K2)/2$" is used and its reciprocal constitutes the radius of curvature at the point.

Figure 4:
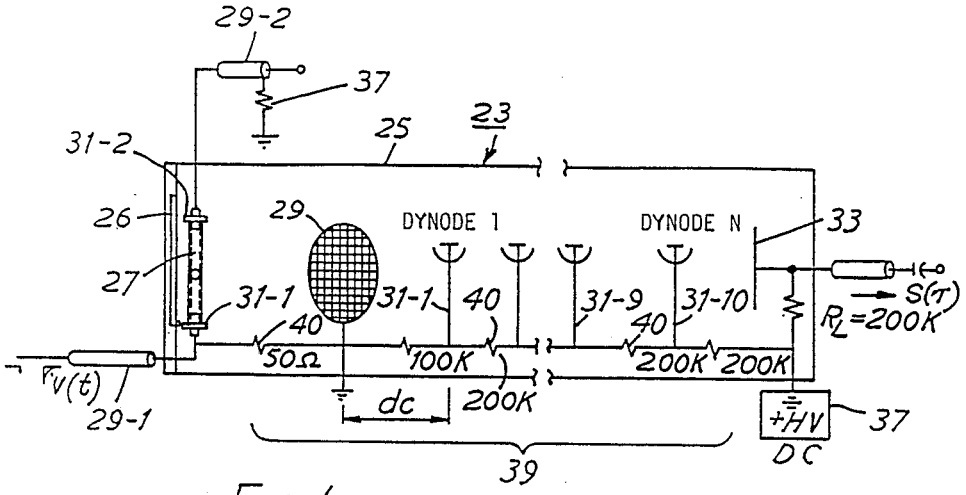
FIG. 4 is a perspective and partially cutaway view of a color picture tube according to an embodiment of this invention.

A color picture tube according to an embodiment of this invention will be described hereinafter with reference to FIGS. 4–8. As shown in FIG. 4, the color picture tube of this invention includes an evacuated glass envelope having a rectangular face panel 3. The inner surface of the face panel 3 is formed with a phosphor screen 8 composed of a regular array of red, green, and blue phosphor stripes or dots. The envelope contains a shadow mask 1 supported via a mask frame 4 and extending between the face panel 3 and electron guns 9. The shadow mask 1 extends near and parallel to the face panel 3. The shadow mask 1 is rectangular in conformity with the face panel 3. A regular array of apertures extend through the shadow mask 1. Electron beams 20 emitted from the electron guns 9 are modulated in accordance with a video signal and are deflected before reaching target phosphor stripes or dots via corresponding apertures in the shadow mask 1.

Figure 6:
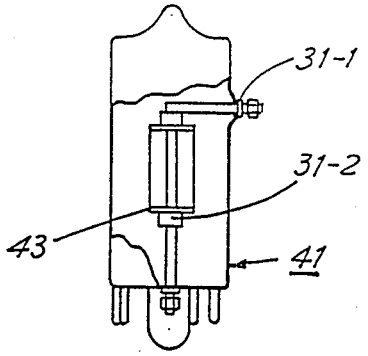
FIG. 6 is a perspective view of part of the shadow mask of FIGS. 4 and 5.
Figure 5:
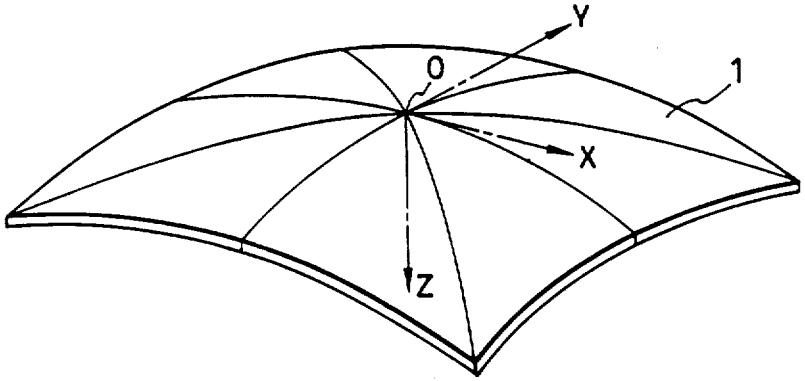
Figure 6:
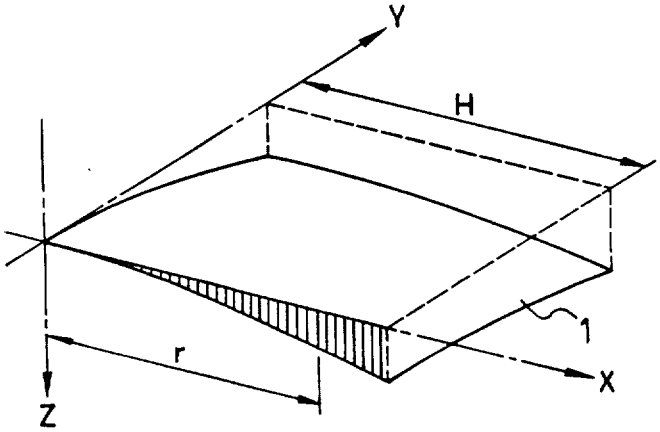
Figure 7:
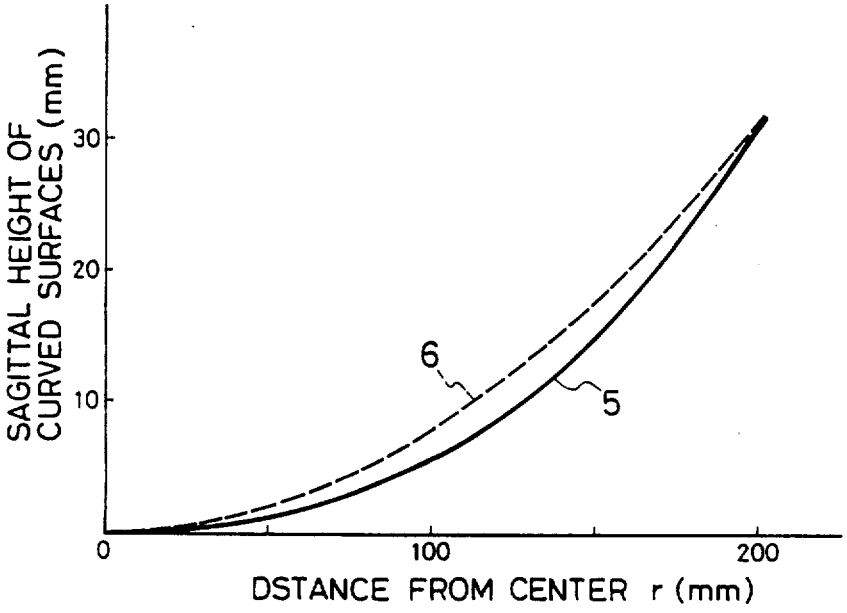
Figure 8:
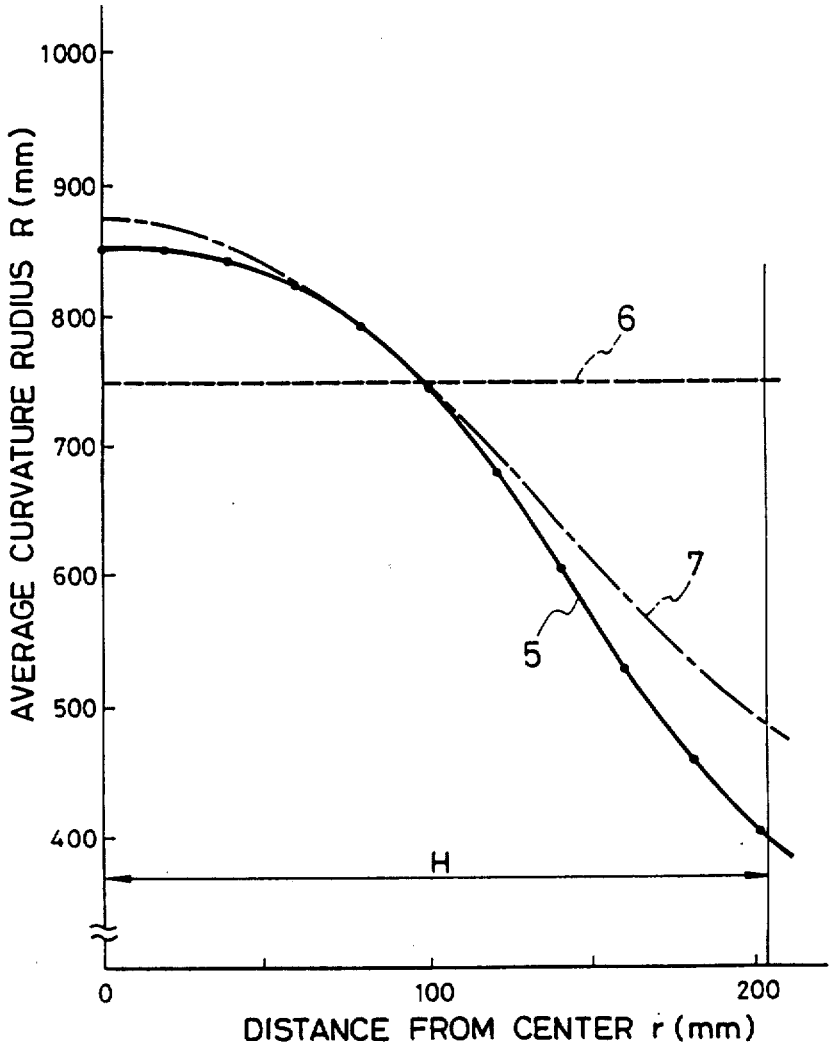

As shown in FIGS. 5 and 6, the character X denotes a coordinate component along the longer axis (X axis) of the rectangular shadow mask 1. The character Y denotes a coordinate component along the shorter axis (Y axis) of the rectangular shadow mask 1. The character Z denotes a coordinate component along the central axis (Z axis) of the color picture tube which is perpendicular to directions of the longer and shorter axes of the shadow mask 1. The outside dimension of the shadow mask 1 along the X axis is given by a value "2H". A sagittal height Z of the mask curved surface which is measured from the mask center (the origin O) is chosen in accordance with the following equation.

$$Z=\alpha1\cdot X^2+\alpha2\cdot X^4+\alpha3\cdot Y^2+\alpha4\cdot X^2\cdot Y^2+\alpha5\cdot X^4\cdot Y^2 +\alpha6\cdot Y^4+\alpha7\cdot X^2\cdot Y^4+\alpha8\cdot X^4\cdot Y^4+\alpha9\cdot X^6 \quad (6)$$

The right-hand side of the equation (6) equals the right-hand side of the equation (5) plus the term "$\alpha9\cdot X^6$".

In a color picture tube having a rectangular shadow mask, a region of the shadow mask which extends outward of points distant from the shadow mask center by an interval H/2 and which is close to the X axis tends to be exposed to local domings. The addition of the term "$\alpha9\cdot X^6$" decreases the radius of curvature and thus prevents or reduces local domings in that region.

When $X/H=x$, $Y/H=y$, and $Z/H=z$, the equation (6) is transformed into the following equation.

$$z=a1\cdot x^2+a2\cdot x^4+a3\cdot y^2+a4\cdot x^2\cdot y^2+a5\cdot x^4\cdot y^2 +a6\cdot y^4+a7\cdot x^2\cdot y^4+a8\cdot x^4\cdot y^4 a9\cdot x^6 \quad (7)$$

For example, in a 21-inch color picture tube having a value H=203.2 mm, coefficients a1–a9 of the equation (7) are given as:

a1=0.1131, a2=0.0336, a3=0.1251, a4=0.1240, a5=0.7732, a6=0.0204, a7=0.0787, a8=$-2.6\times10^{-6}$, a9=0.0185.

Figure 7:
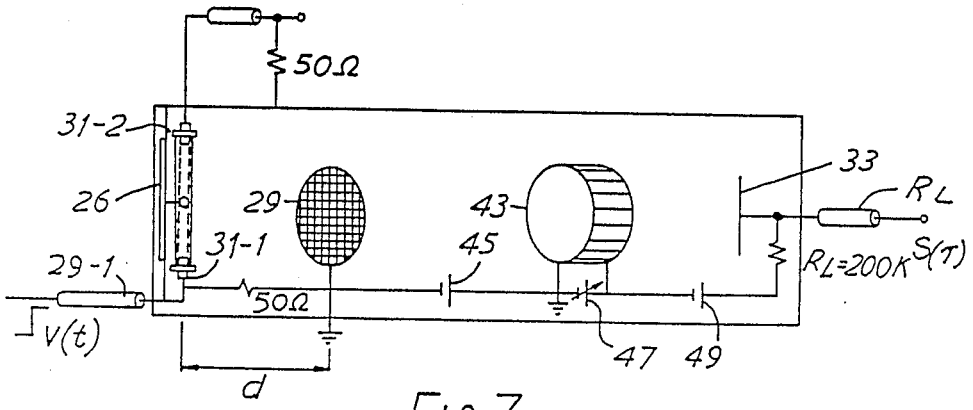
FIG. 7 is a graph of sagittal height characteristics of the shadow mask of FIGS. 4–6 and a prior art shadow mask.
Figure 5A:
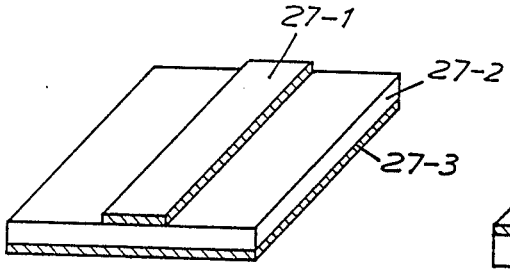
FIG. 5 is a perspective view of the shadow mask of FIG. 4.
Figure 5B:
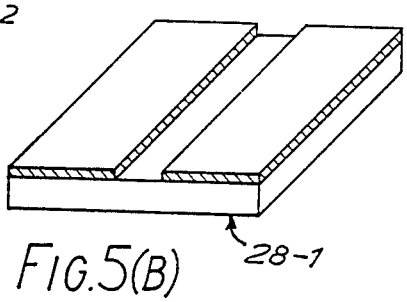
Figure 5C:
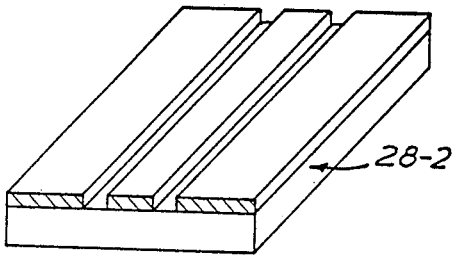
Figure 5D:
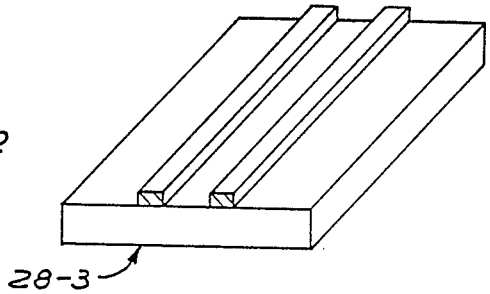

As shown in FIG. 7, the shadow mask curved surface 5 of this embodiment has characteristics that the sagittal height at a point on the X axis increases with the distance r between the point and the shadow mask center O along the X axis. In this case, the sagittal height is measured from the shadow mask center O. In FIG. 7, the broken line 6 indicates a prior art shadow mask curved surface designed in accordance with the equation (2).

Figure 8:
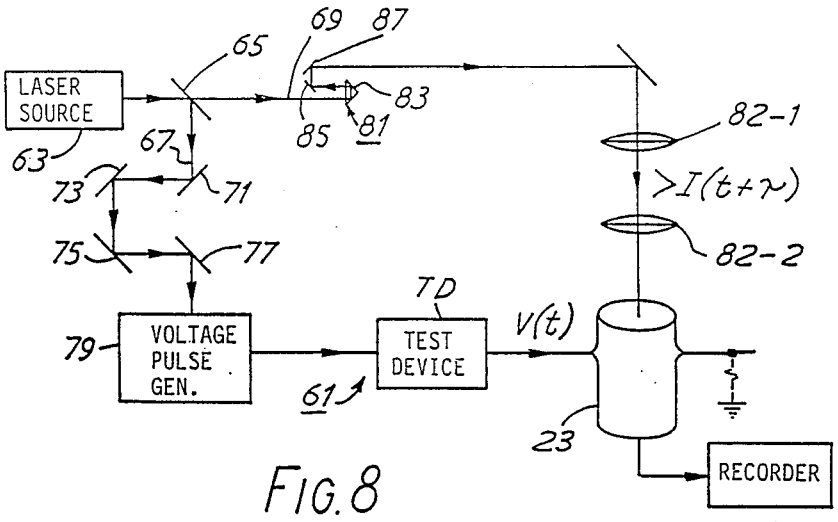
FIG. 8 is a graph of average radii of curvatures of the shadow mask of FIGS. 4–6 and prior art shadow masks.
Figure 10:
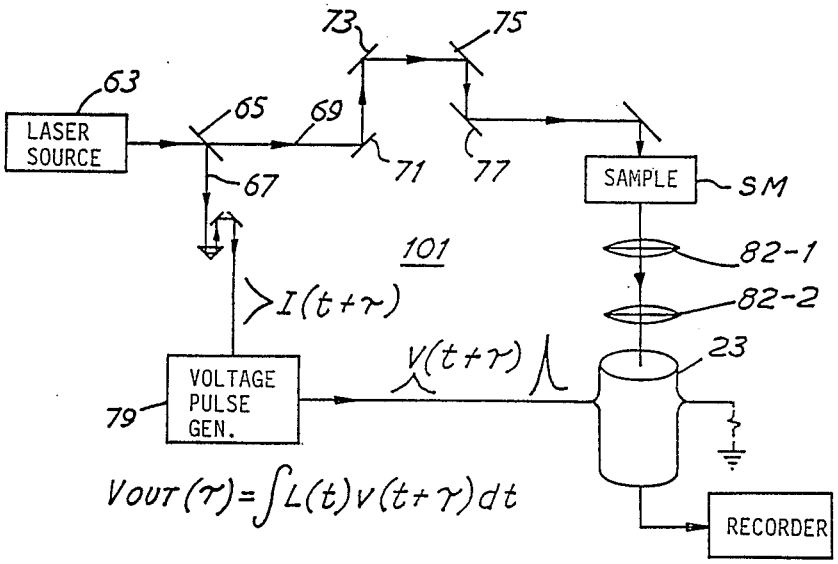
Figure 9:
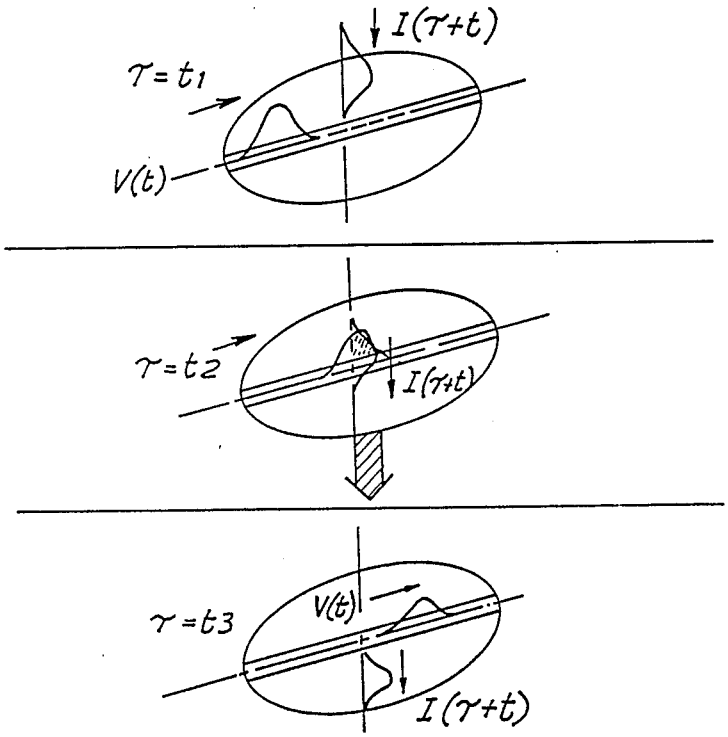
Figure 1:
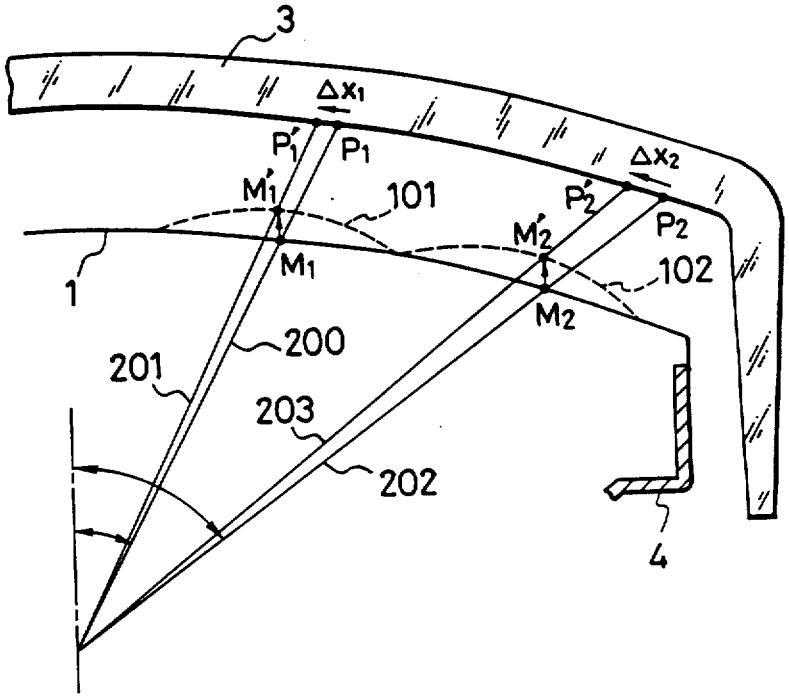
FIG. 1 PRIOR ART
Figure 3:
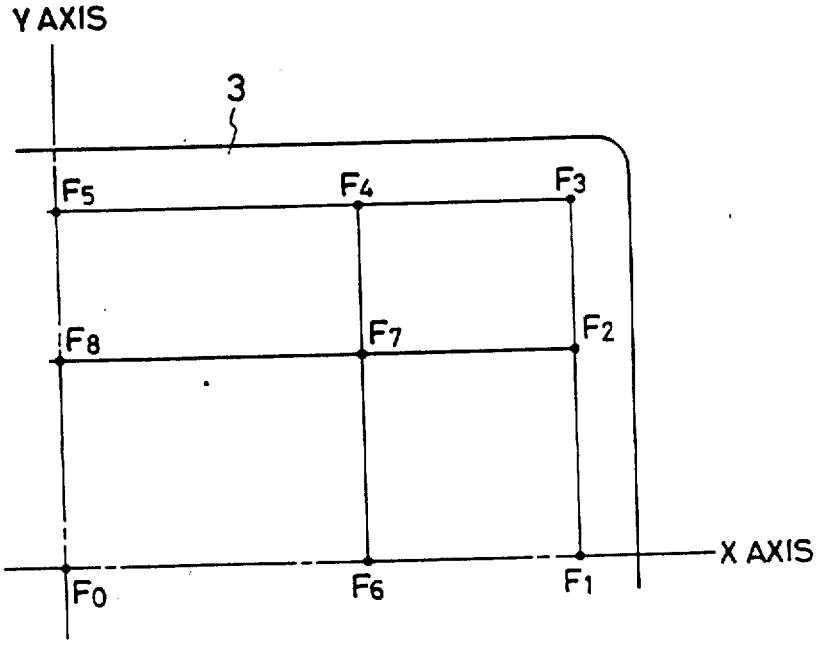
FIG. 3 PRIOR ART
Figure 2:
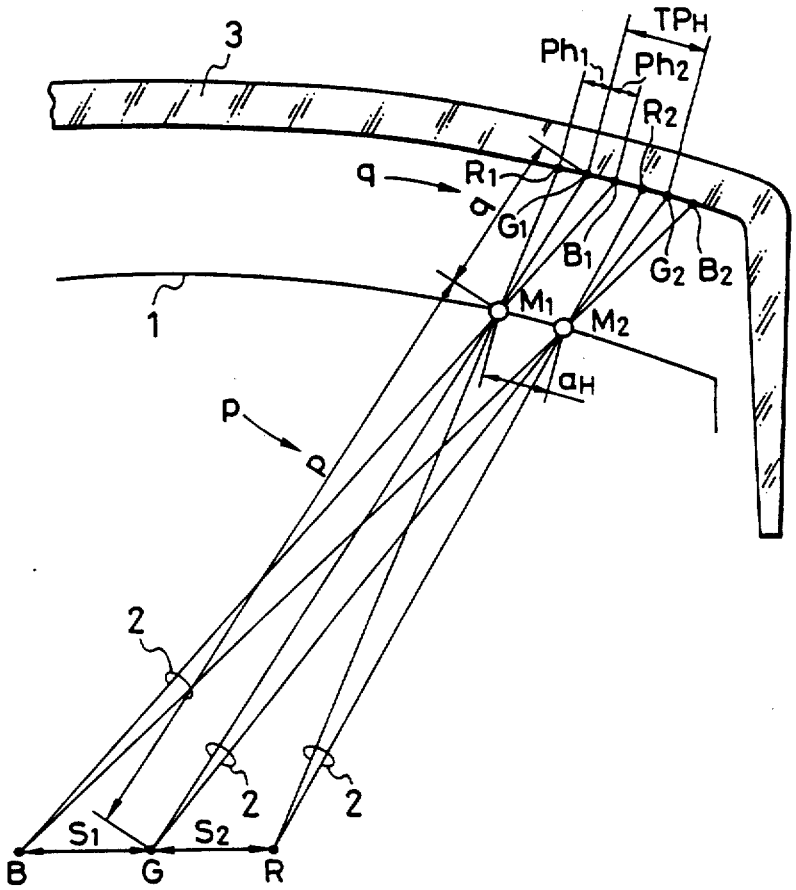
FIG. 2 PRIOR ART
Figure 4:
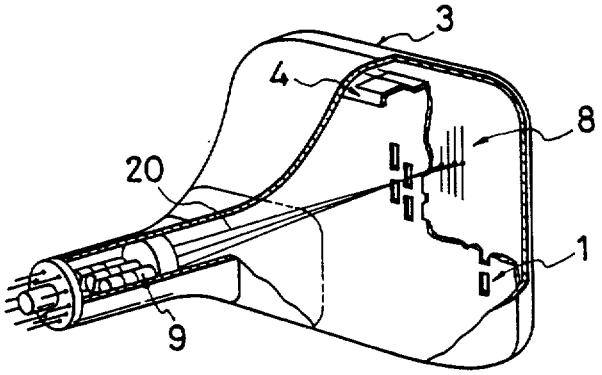

As shown in FIG. 8, the average radius of curvatures at points on the X axis in the shadow mask curved surface 5 of this embodiment decreases with the distance r from the shadow mask center O along the X axis. In FIG. 8, the broken line 6 denotes corresponding characteristics of a prior art shadow mask curved surface designed in accordance with the equation (2). In addition, the broken line 7 denotes the corresponding characteristics of a prior art shadow mask curved surface designed in accordance with the equation (5).

As understood from FIGS. 7 and 8, the addition of the term "$\alpha 9S^6$" allows the average radius of curvatures of the shadow mask curved surface of this embodiment to be smaller than those of the prior art shadow mask curved surfaces in the region where $H/2<r<H$. The small average radius of curvatures prevents or reduces local domings.

The absolute value of the coefficient a9 in the equation (7) is preferably smaller than 0.3. In the case where the coefficient a9 is larger than $-0.3$ but smaller than 0, the term "$a9X^6$" reduces variations in the curvature caused by the other terms in the equation (7). Specifically, in a region near the edges, the term "$a9X^6$" compensates for variations in the curvature caused by the fourth-degree X or Y terms, preventing increases in the array pitch and thus preventing decreases in the resolution.

What is claimed is:

1. A color picture tube comprising of a rectangular shadow mask having a longer axis and a shorter axis, the shadow mask having a curved surface, wherein a point of the curved surface of the shadow mask is represented by an orthogonal coordinate system having an X component, a Y component, and a Z component, the coordinate system having an origin coincident with a center of the curved surface, the X component being measured along the longer axis, the Y component being measured along the shorter axis, the Z component being measured in a direction perpendicular to directions of the longer the shorter axes, wherein a sagittal height of the curved surface represented by the Z component and measured from the origin is given by a polynomial including a term of sixth-degree power of one of the X component and the Y component, the sagittal height represented by a value z which is given by the following equation:

$$z=a1\cdot x^2+a2\cdot x^4+a3\cdot y^2+a4\cdot x^2\cdot y^2+a5\cdot x^4\cdot y^2+a6\cdot y^4+a7\cdot x^2\cdot y^4+a8\cdot x^4\cdot y^4+a9\cdot x^6$$

where $X/H=x$, $Y/H=y$, $Z/H=z$, a value of 2H equals the length of the longer axis of the shadow mask, and a1–a9 represent predetermined coefficients.

2. The color picture tube of claim 1 wherein an absolute value of the coefficient a9 is smaller than 0.3.

* * * * *

UNITED STATES PATENT AND TRADEMARK OFFICE

CERTIFICATE OF CORRECTION

PATENT NO. : 4,837,482

DATED : June 6, 1989

INVENTOR(S) : Osamu Adachi et al

It is certified that error appears in the above-identified patent and that said Letters Patent is hereby corrected as shown below:

TITLE PAGE:

The Title Page should be deleted and should read as per attached sheet.

IN THE DRAWINGS:

Delete all sheets of drawings and insert sheets of drawings, Figures 1-8, as shown on the attached sheets.

Signed and Sealed this

Eighth Day of May, 1990

*Attest:*

HARRY F. MANBECK, JR.

*Attesting Officer*

*Commissioner of Patents and Trademarks*

United States Patent [19]

Adachi et al.

[11] Patent Number: 4,837,482

[45] Date of Patent: Jun. 6, 1989

[54] COLOR PICTURE TUBE HAVING REDUCED LOCAL DOMING

[75] Inventors: Osamu Adachi, Osaka; Osamu Konosu, Kyoto, both of Japan

[73] Assignee: Matsushita Electronics Corporation, Japan

[21] Appl. No.: 172,391

[22] Filed: Mar. 24, 1988

[30] Foreign Application Priority Data

Mar. 26, 1987 [JP] Japan ..... 62-72449

[51] Int. Cl.[4] ..... H01J 29/07

[52] U.S. Cl. ..... 313/402; 313/408

[58] Field of Search ..... 313/402, 408

[56] References Cited

U.S. PATENT DOCUMENTS 4,677,339 6/1987 Inoue et al. ..... 313/402

*Primary Examiner*—Kenneth Wieder

*Attorney, Agent, or Firm*—Lowe, Price, LeBlanc, Becker & Shur

[57] ABSTRACT

A color picture tube includes a rectangular shadow mask having a longer axis and a shorter axis. The shadow mask has a curved surface. A point of the curved surface of the shadow mask is represented by an orthogonal coordinate system having an X component, a Y component, and a Z component. The coordinate system has an origin coincident with a center of the curved surface. The X component is measured along the longer axis. The Y component is measured along the shorter axis. The Z component is measured in a direction perpendicular to directions of the longer and shorter axes. A sagittal height of the curved surface represented by the Z component and measured from the origin is given by a polynomial including a term of a sixth-degree power of one of the X component and the Y component.

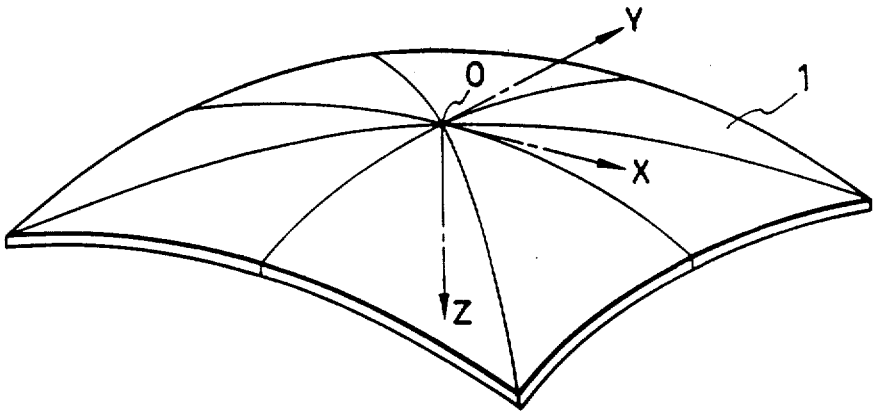

2 Claims, 5 Drawing Sheets